United States Patent [19]

Bickley

[11] Patent Number: 4,839,480

[45] Date of Patent: Jun. 13, 1989

[54] VEHICLE SENSING DEVICE

[75] Inventor: Alan Bickley, Gretna, Scotland

[73] Assignee: The Gates Rubber Company, Denver, Colo.

[21] Appl. No.: 117,280

[22] Filed: Nov. 4, 1987

[30] Foreign Application Priority Data

Nov. 5, 1986 [GB] United Kingdom ..... 8626395
Apr. 4, 1987 [GB] United Kingdom ..... 8708106

[51] Int. Cl.[4] ..... H01H 3/16

[52] U.S. Cl. ..... 200/86 A; 338/114; 340/666; 200/86 R

[58] Field of Search ..... 340/933, 665, 666, 667; 200/85 R, 86 R, 86 A, 302.1, 308, 333; 307/119; 74/115, 52 PE; 338/113, 114; 361/179

[56] References Cited

U.S. PATENT DOCUMENTS 3,794,790 2/1974 Leyland ..... 200/86 R
4,172,216 10/1979 O'Shea ..... 340/666
4,529,959 7/1985 Ito ..... 338/114
4,742,196 5/1988 Kelly ..... 200/85 R

FOREIGN PATENT DOCUMENTS 2078006 12/1981 United Kingdom .

*Primary Examiner*—Gerald P. Tolin
*Attorney, Agent, or Firm*—C. H. Castleman, Jr.; H. W. Oberg, Jr.; J. E. Ebel

[57] ABSTRACT

A vehicle sensing device comprises an electrically insulating elongate carrier (1) with two electrical conductors (2,3) extending longitudinally of the carrier and spaced apart transversely of the carrier so that there is no direct contact between the conductors. A strip (14) of elastomeric material overlies both conductors and is in contact therewith in areas distributed along substantially the whole of their length. The strip (4) being such that in the absence of a given level of applied pressure the strip forms a barrier of high electrical resistance between the conductors, and that in the presence of applied pressure above the given level in any region of the strip, that region of the strip forms an electrically conductive path between the conductors. The carrier, conductors and strip are wholly encapsulated in a jacket of water-resistance and abrasion-resistance elastomeric material.

15 Claims, 4 Drawing Sheets

VEHICLE SENSING DEVICE

This invention relates to a vehicle sensing device. Many types of sensing devices are available for detecting and counting vehicles or other objects passing a given location, but there is a constant need for more robust and reliable sensors.

According to a first aspect of the invention a vehicle sensing device comprising an electrically insulating elongate carrier; two electrical conductors extending longitudinally of the carrier and spaced apart transversely of the carrier so that there is no direct contact between the conductors; a strip of elastomeric material overlying and in contact with both conductors in areas distributed along substantially the whole of their length, the strip being such that in the absence of a given level of applied pressure the strip forms a barrier of high electrical resistance between the conductors, and that in the presence of applied pressure above the given level in any region of the strip, that region of the strip forms an electrically conductive path between the conductors; and a jacket of water-resistant and abrasion-resistant elastomeric material, wholly encapsulating the carrier, conductors and strip.

Such devices can be made in long lengths, and a change in the electrical resistance experienced between the conductors will be caused in response to pressure applied anywhere along the device. The resistance change may be detected by any suitable electrical circuit connected to the conductors, and the circuit may respond to the change to operate counting or analysis devices as required.

There are two principal forms which such sensing device may take. In the first, the strip is in substantially continuous contact with both conductors, and the elastomeric material of the strip is such as to exhibit significant change in electrical resistance in response to the given level of applied pressure. In the second, the strip comprises a flat body of electrically conductive elastomeric material and protrusions from at least one surface of the flat body, the protrusions lying in contact with the conductors and, in the absence of the given level of applied pressure, spacing the flat body out of contact with the conductors.

In the first form of the device the resistance or conductivity of the matrial of the strip changes in response to the applied pressure, and current flowing in an electric circuit connected to the conductors will accordingly change, such change being detectable. In the second form of the device the strip effectively acts, at the point of applied pressure, as a simple bridging contact between the conductors.

Either form of the device may advantageously include a wrapping or jacket which will give protection to the carrier, electrodes and strip.

In one preferred embodiment of the invention the carrier, is a strip of electrically insulating plastics material and the conductors are formed by spaced layers of conductive metal formed on or adhered to the strip. One problem that may be encountered with a device of this form arises from the fact that the carrier strip and the conductors have different coefficients of expansion, and there is therefore the possibility that the adhesion between then may fail under elevated temperature conditions. Such temperature conditions may arise because of the environment in which the device is used, or may arise during manufacture.

This problem can be prevented in accordance with a further preferred feature of the invention, wherein the conductors are formed on or adhered to a first surface of the carrier strip, and the second surface of the carrier strip is bonded to a backing strip of material that has a coefficient of thermal expansion closer to that of the material of the conductors than to that of the material of the carrier strip. In this construction, the backing strip has the effect of holding the carrier strip from expanding to a degree that will be sufficient to cause failure of the adhesive between the carrier strip and the conductors. Desirably the coefficients of expansion of the materials of the conductors and backing strip material are similar, and when the conductors are metal then the backing strip is preferably also of metal.

It is convenient to store long sensing devices by winding them into a coiled form, and then to lay them by unwinding the coil. A further phenomenon that can cause failure of adhesion between the conductors and the carrier strip is kinking, and desirably this is prevented by selecting a backing strip material that will resist kinking and permanent set under application of a bending moment. The preferred material for the further strip is spring steel, but other metals or engineering grade thermoplastic materials are possible. Spring steel gives the required protection both against kinking and against the effect of differential thermal expansion.

Preferably the width of the backing strip is not less than the width of the carrier strip and not more than three times the width of the carrier strip. Desirably the width of the backing strip does not exceed 8 mm, and more desirably is in the range of 3 to 5 mm.

The jacket may be secured to a highway by adhesive or other means. When a vehicle axle passes over the jacket pressure will be applied to and released from the elastomeric strip, and a resistance change will occur which can be detected by a circuit connected to the conductors. The number of such changes and their frequency can be counted by the circuit, and analysis can give a measure of the number and types of vehicle passing over the devices. Analysis is assisted if the matrial of the strip exhibits a resistance or conductivity curve that undergoes a gradual change over a wide range of applied pressures. Thus, apart from giving an output signal indicative of a simple abrupt change in resistance, measurement of the resistance can give information related to the axle weight and therefore the type of vehicles.

Another application of the device is in monitoring vehicle speed. If two devices are placed a known distance apart then the signals from sucessive devices as a known vehicle pases over them will give a measure of the time taken, and the speed can thus be calculated.

In one embodiment the jacket may be shaped to have a substantially flat base surface for contact with a roadway, and an upper surface for contact by a vehicle, the carrier, conductors and strip extending through the jacket as a flat element substantially parallel to the base surface of the jacket, with the strip of elastomeric material being closer to the upper surface than to the base of the jacket.

Preferably at least that part of the jacket material lying below the upper surface of the elastomeric strip has a Shore A hardness of 70 to 95. The thickness of jacket material above the upper surface of the elastomeric strip is desirable from 2 to 4 mm, and the Shore A hardeness of this material lying above the upper surface of the elastomeric strip is preferably no greater than the Shore A hardness of the jacket material lying below the upper surface of the elastomeric strip.

Using jacket material that is softer above the elastomeric strip than below the strip increases the sensitivity of the sensor, and by suitable choice of materials the sensor can be tailored to respond as required in a given environment.

In order to give the required indications the sensing device needs to be connected into a suitable electrical circuit. Accordingly, the device preferably includes a twin-conductor connecting cable extending from one end of the device for connection to such circuit, each cable conductor being electrically connected to a respective one of the conductors of the sensing device, and the region of connection being encapsulated within the jacket material. An integral sensing device structure is thus provided. Problems can be experienced in forming and maintaining a suitable robust connection. Desirably these can be overcome by surrounding the region of connection with a tube of rigid material extending from the end region of the connector cable to beyond the region of connection, the interior of the tube being filled with electrically insulating material, and the tube being encapsulated in the jacket material.

A polyurethane material is preferred for the jacket, and a high temperature curing MDI-polyether material has been found to be particularly suitable.

Devices in accordance with the invention will now be described in more detail, by way of example only, with reference to the ac ompanying drawings in which.

Figure 1:
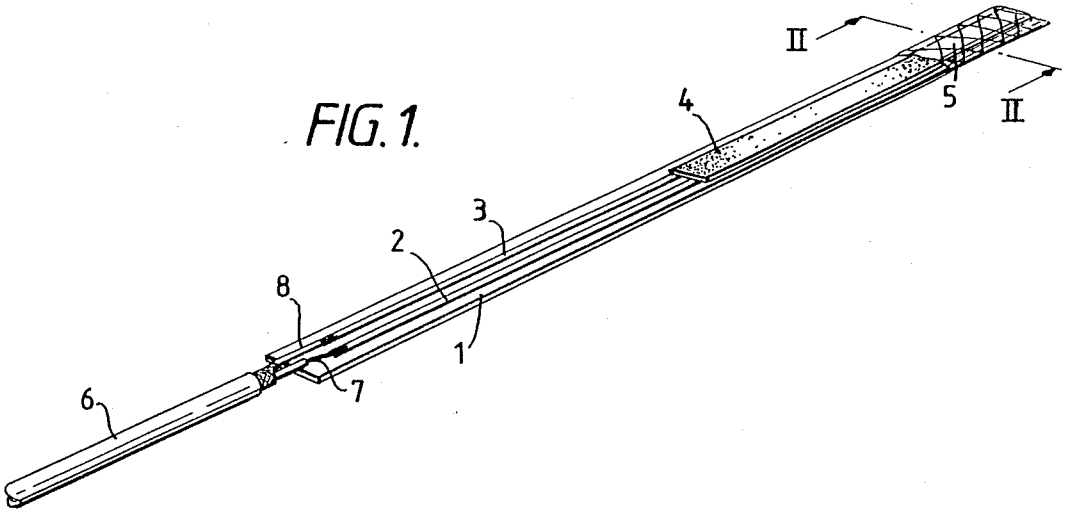
FIG. 1 is an exploded view of a first form of sensor unit for incorporation into a device.

Referring now to FIG. 1 a sensor unit for incorporation into a sensing device comprises an elongate carrier 1 of electrically insulating material, which desirably is also flexible, has good fatigue properties and is capable of withstanding high temperatures. One example of such material is the polymide sold by Dupont under the trade mark "Kapton". Two transversely spaced copper conductors 2 and 3 extend longitudinally of the carrier and are bonded thereto. The conductors may be formed on or adhered to the carrier by any suitable method; one such method would be to follow the photoresist and etching techniques used in the manufacture of printed circuits.

Overlying and in contact with the conductors 2 and 3 there is a strip 4 of elastomeric material that exhibits significant change in electrical resistance in response to applied pressure. Suitable materials for the strip 4 are those known as pressure conductive rubbers. such materials comprise an elastomeric matrix loaded with particles of electrically conductive or semi-conductive material. In the uncompressed state the matrix exhibits a high resistance, but when the material is compresed the resistance falls. One set of examples of such materials is given in GB-A1561189 to the Yokohama Rubber Co Ltd, and in one particular example of the sensor element a strip of the material designated Yokohama CS-57-7RSC, 0.5 mm in thickness, has been used. Other materials are disclosed in our pending GB application No. 8616033. The elastomeric strip may simply be laid onto the conductors, or the strip may be bonded to the carrier and conductor structure by a suitable adhesive. A polyester adhesive tape 5 is wound around the assembly. The tape is obviously necessary if no adhesive is used between the elastomeric strip and the carrier, but it could be omitted if there is an adhesive bond between these other elements.

At one end of the sensor unit, which it will be appreciated is in the form of a flexible strip of any required length, a two-conductor connecting cable 6, conveniently in the form of a coaxial cable, has its two conductors 7, 8 soldered to the conductors 2 and 3 respectively.

It will readily be seen that the other end of the connecting cable 6 may be connected as a resistor into a suitable electrical circuit. When the elastomeric strip 4 is in its uncompressed condition along its full length then the sensor unit exhibits very high resistance. If pressure is applied to the elastomeric strip at any point along its length then the resistance at that point will fall, and the resistance of the whole unit will also fall accordingly. This drop may be detected by the electrical circuit and may be used to operate any required counting or analysis device.

Figure 2:
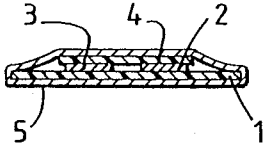
FIG. 2 is a cross-section on line II—II of FIG. 1.
Figure 3:
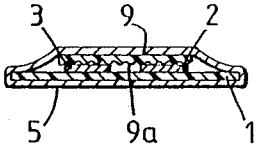
FIG. 3 is a cross-section, similar to FIG. 2, of a second form of sensor unit.

In the modified sensor unit shown in FIG. 3 the strip of elastomeric material differs from that of the device of FIGS. 1 and 2. In this embodiment, the strip has a flat, electrically conductive body 9, with a pattern of protrusions 9*a* of electrically insulating material printed or otherwise formed on one surface thereof. In the uncompressed state, the protrusions hold the body 9 out of contact with the conductors 2 and 3, so that there is no electrical connection between the conductors. When pressure is applied to the strip, part of this will be depressed to bring the conductive body 9 into contact with the conductors and so complete an electrical connection.

Figure 4:
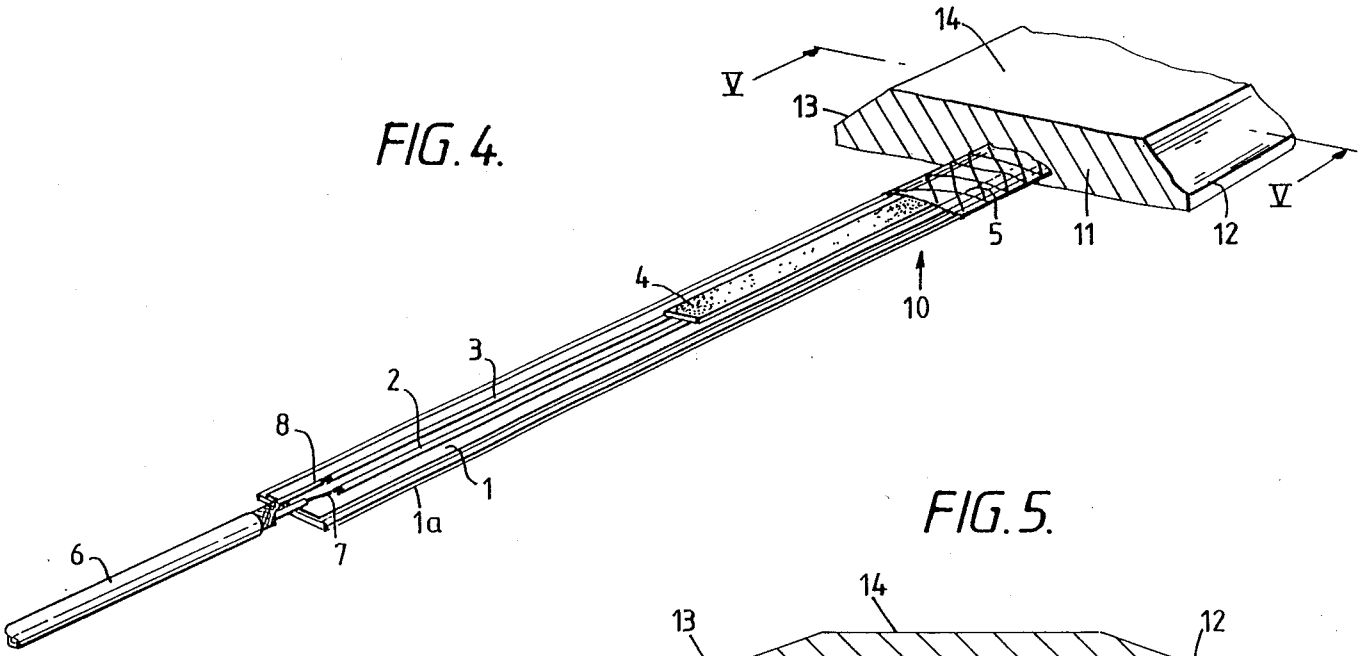
FIG. 4 is an exploded view of a third form of sensor unit suitably encapsulated view of a vehicle sensing device.

The sensor unit embodied in the traffic sensor of FIG. 4 is similar in many respects to the device shown in FIG. 1. In this embodiment, however, the lower face of the carrier 1 is bonded by an adhesive, desirably a cyanoacrylate type adhesive, to a thin strip of spring steel 1*a*, of width not less than the width of the carrier strip and more than three times the width of the carrier strip. The preferred width is slightly more than the carrier strip width as shown, and such width may be from 3 to 5 mm, preferably about 4 mm. The spring steel strip gives protection against differential thermal expansion of the carrier strip and conductor, and also prevents damage of the strip due to kinking. The device of FIG. 4 may, of course be modified by using an elastomeric strip of the type shown in FIG. 3.

Either form of the resulting sensor unit 10 is encapsulated in a water-resistant and abrasion-resistant jacket 11 of elastomeric material. The jacket material, in addition to having good resistance to abrasion and water, desirably is also tear-resistant and resistant to weathering. Preferred material is a high temperature curing MDI-polyether material, which has excellent resistance to aqueous environments, good abrasion resistance, good tear strength and a high modulus. A black dye is desirably added to the polymer in order to provide protection against ultra-violet radiation and to improve the appearance of device. One alternative material is Flexane 80 or Flexane 94 polyrethane from Devcon, other materials are, of course, possible. Desirably there is a 2 to 4 mm thickness of jacket material above the sensor unit 10, sufficient to protect this, but not sufficient to reduce significantly load transmission to the elastomeric strip 4. The hardness of the jacket material lying below the upper surface 4 of the strip is desirably no less than that of the jacket material lying above the strip. The lower mass of jacket material desirably has a hardness of from 70 to 95 Shore A, around 90 being preferred. The hardness of the upper mass should not be less than 50 Shore A, and is desirably from 60 to 85, preferably around 70 .

Encapsulation may simply be effected using a heated aluminum mould. A first layer of polyurethane is cast, the sensor unit 10 is positioned on this first casting, and a further layer of polyurethane is then poured and cast to encapsulate the unit. The resulting sensing device is removed and post-cured. The spring steel backing strip prevents the carrier 1 from expanding to a degree sufficient to destroy the bond between the carrier and the conductors 2 and 3. The steel also gives the sensing device sufficient resilience to enable it to be rolled without kinking of the carrier and conductors.

Figure 5:
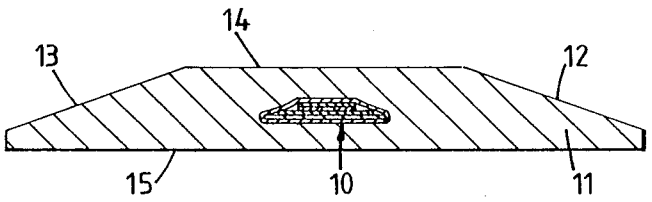
FIG. 5 is a cross-section on the line V—V of FIG. 4.

The device shown in FIGS. 4 and 5 is substantially trapezoidal in shape, having sloping front and rear shoulders 12, 13 and a flat top 14. It has been found that this is the optimum shape for resisting wear, resisting detachment from the carriageway surface to which the device is secured, and allowing the transfer of vertical loads to the elastomeric strip 4 whilst minimising the horizontal interaction with passing vehicles, to reduce any bump experienced by the vehicle.

The device of FIGS. 4 and 5 is designed to be secured to a carriageway by suitable adhesive between the lower surface 15 of the device and the carriageway. It will be seen that the device is flexible so that it may simply be unrolled on site and secured by the appropriate adhesive. In alternative fixing arrangements, lugs, baands or straps may be moulded into or secured around the device at spaced points along its length, those lugs, bands or straps then being secured to the carriageway either by adhesive, by road nails or by other suitable means.

Figure 6:
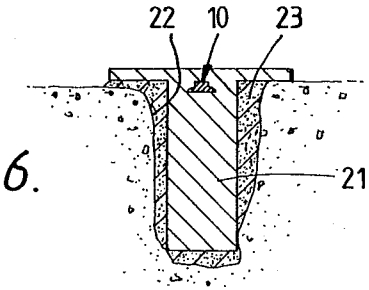
FIG. 6 is a cross-section through a second form of vehicle sensing device.

The device of FIGS. 4 and 5 is designed principally for relatively short term use. FIG. 6 is a cross-section through a device designed for more permanent installation, appropriately fitted into a road surface. The actual sensor unit 10 is similar to that already described with reference to FIG. 3, but the shape of the elastomeric body 21 in which the unit is encapsulated differs from that already described. The body is designed to be accommodated in a slot 22 cut into the road surface, the device being held in position in the slot by suitable grouting material or adhesive 23.

In order to connect either of these forms of vehicle sensing device to an electrical circuit a two-conductor connecting cable may have its two conductors soldered to the conductors of the sensing device as shown in FIG. 1. The connection region is desirably also encapsulated in the elastomeric jacket 11.

Figure 7:
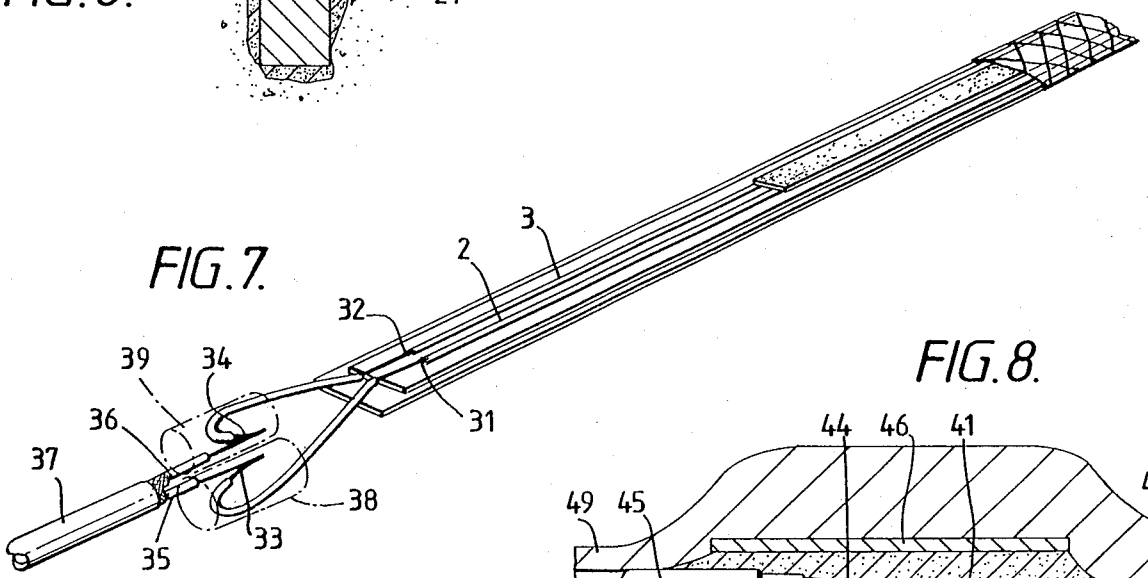
FIG. 7 is an enlarged view of a first end construction of a vehicle sensing device.

FIG. 7 shows an alternative system for connecting the conductors to a cable so as to provide further protection for this critical region of the device. In this arrangement, short lengths of flexible connection wire, each with a silicon rubber sheath, are soldered at first ends 31, 32 respectively to the conductors 2 and 3, and are soldered at their other ends 33, 34 respectively to the conductors 35, 36 of a coaxial cable 37. The two connections to the coaxial cable are each protected by a length of tubing 38, 39 shrink-wrapped around the joint. The whole of the connection may again be encapsulated in the elastomeric material.

Figure 8:
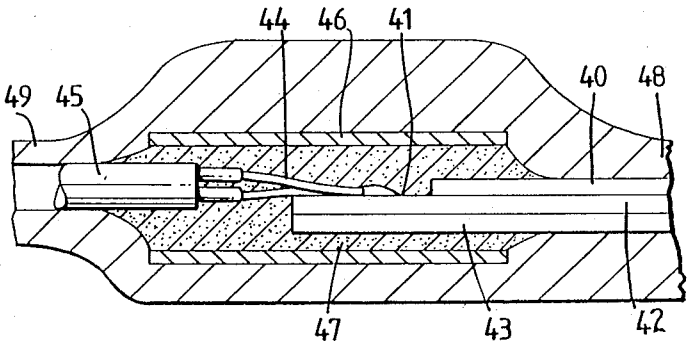
FIG. 8 is a sectional view through a second end construction of a vehicle sensing device.

FIG. 8 shows a connection arrangement for the end of the sensing device that gives even grater protection. In this arrangement the sensing device is generally as shown in FIG. 4, comprising an elastomeric strip 40 overlying copper conductors 41 on a carrier strip 42 with the spring steel backing plate 43. The elastomeric material terminates short of the end of the sensing device so that parts of the conductors 41 are exposed in this connection region. The two conductors such as 44 of a connecting cable 45 are soldered to the conductors 41. The connection region is surrounded by a tube 46 of rigid material, for example a steel tube, that extends from the end region of the connector cable to beyond the region of connection and indeed to a location wherein part of the tube surrounds part of the elastomeric strip 40. Free space within the interior of the tube 46 is filled with electrically insulating material 47. In this way the connection region is protected from the shear or other forces that may be experienced at the ends of the vehicle sensing device. The whole constuction is encapsulated in the jacket material 48, which is desirably enlarged in the connection region and extended as at 49 to give additional protection to the cable 45.

Figure 9:
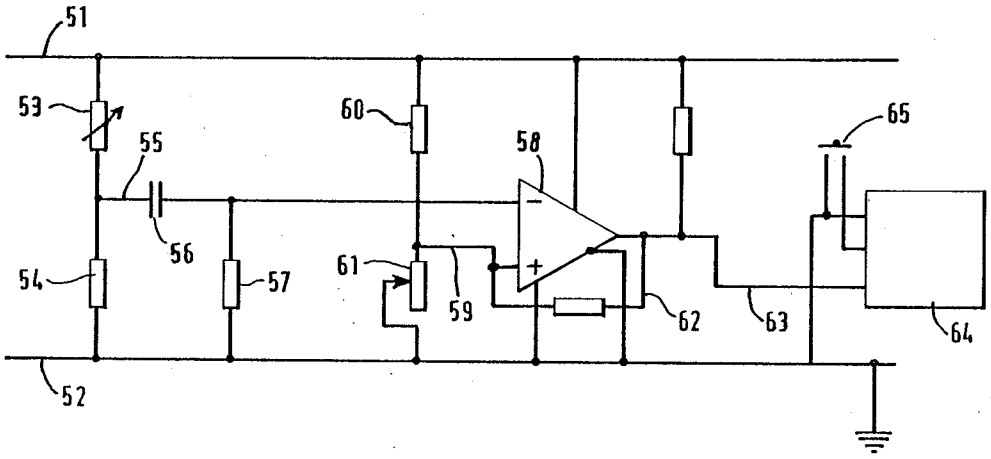
FIG. 9 is a circuit diagram of a counter which may be utilised in association with a vehicle sensing device.

It has been found that the resistance of the elastomeric strip, where this is of the type in which resistance changes with pressure, has a tendency to drift when the strip is in its uncompressed state. For practical long term use in vehicle detection, therefore, it is preferable to utilise abrupt change in resistance rather than absolute value of resistance. FIG. 9 shows a suitable circuit for counting the number of times that the device of FIG. 4 is placed under pressure by a vehicle wheel. A DC voltage is applied between lines 51 and 52. The sensing device 53 is connected in series with a first resistor 54 between the lines 51 and 52. The value of resistor 54 is chosen to be similar to the resistance of the elastomeric strip in its uncompressed state. If using, for example, a 3.5 metre length of the Yokohama CS-57-7RSC material measuring 4 mm $\times$0.5 mm, this has an uncompressed resistance of aproximately 100,000 ohms, and resistance 54 would therefore be chosen to have this value. The device 53 and resistance 54 therefor act as a voltage divider and from between them a line 55 extends to one side of a capacitor 56, the other side of which is connected through resistor 57 to ground and also to one input of a comparator 58. The other input of the comparator receives a reference voltage on line 59, taken from between fixed resistor 60 and variable resistor 61 connected between the lines 51 and 52. There is a conventional feedback loop 62 connected to the comparator and its output line 63 is connected to a counter 64 having a reset switch 65.

In operation the capacitor 56 and resistor 57 act as a differentiating circuit, and will absorb any slow drift in the value of the resistance of the device 53. However, any very rapid drop in resistance caused by a vehicle wheel travelling over the device will cause a current surge on line 55 that will not be absorbed by the capacitor and a signal will accordingly pass to the first input of the comparator 58. If this exceeds the reference voltage on the second input to the comparator (set at an appropriate value by adjusting resistance 61) then the comparator will give a square wave output pulse on line 63 which will be counted by the counter 64. An accurate count is thus received, which is unaffected by drift in the base resistance value.

It will be appreciated that the FIG. 9 circuit is of simple form, and will only give a count of pressure drops. More sophisticated circuitry may be designed to enable vehicle type detection, by measuring the value of the resistance drop and also by measuring the time between successive drops, in order that axle loading and axle numbers of vehicles may be checked. It will also be appreciated that two vehicle sensing devices may be spaced apart by a given distance, each device having a circuit similar to that shown in FIG. 9 connected thereto, but with the respective output lines 63 connected to a further circuit that will measure the delay between the first pulse from the first device and the first pulse from the second device. This delay may be converted into a direct reading of vehicle speed between the two devices.

In another arrangement more than two conductive strips are incorporated in the sensing device, with different transverse spacings between them. Resistances between successive pairs of strips will change at different times as a vehicle wheel passes over the detector, and the resultant trace an be analysed to give vehicle recognition data that may be more accurate than that otherwise obtainable.

I claim:

1. A sensing device comprising an electrically insulating elongate carrier; two electrically conductors extending longitudinally of the carrier and spaced apart transversely of the carrier so that there is not direct contact between the conductors; a strip of elastomeric material overlying and in contact with both conductors in areas distributed along substantially the whole of their length, the strip being such that in the absence of a given level of applied pressure the strip formsd a barrier of high electrical resistance between the conductors, and that in the presence of applied pressure above the given level in any region of the strip, that region of the strip forms an electrically conductive path between the conductors; and a jacket of water-resistant and abrasion-resistant elastomeric material, wholly encapsulating the carrier, conductors and strip.

2. A sensing device according claim 1 in which the strip is in substantially continuous contact with both conductors, and the elastomeric material of the strip is such as to exhibit significant change in electrical resistance in response to the given level of applied pressure.

3. A sensing device according to claim 1 in which the strip comprises a flat body of electrically conductive elastomeric material and protrusions from at least one surface of the flat body, the protrusions lying in contact with the conductors and, in the absence of the given level of applied pressure, spacing the flat body out of contact with the conductors.

4. A sensing device according to claim 3 in which the carrier is a strip of electrically insulating plastics material and the conductors are formed by spaced layers of conductive metal formed on or adhered to the strip.

5. A sensing device according to claim 4 in which the conductors are formed on or adhered to a first surface of the carrier strip, and the second surface of the carrier strip is bonded to a backing strip of material that has a coefficient of thermal expansion closer to that of the material of the conductors than to that of the material of the carrier strip.

6. A sensing device according to claim 5 in which the backing strip is of a material that will resist kinking and permanent set under application of a bending moment.

7. A sensing device according to claim 6 in which the backing strip is of spring steel.

8. A sensing device according to claim 5 in which the width of the backing strip is not less than the width of the carrier strip and not more than three times the width of the carrier strip.

9. A sensing device according to any one of the preceding claims in which the jacket is shaped to have a substantially flat base surface for contact with a roadway, and an upper surface for contact by a vehicle, and the carrier conductors and strip extend through the jacket as a flat element substantially parallel to the base surface of the jacket, with the strip of elastomeric material being closer to the upper surface than to the base of the jacket.

10. A sensing device according to claim 9 in which at least that part of the jacket material lying below the upper surface of the elastomeric strip has a Shore A hardness of 70 to 95.

11. A sensing device according to claim 10 in which the thickness of the jacket material overlying both conductors above the upper surface of the elastomeric strip is from 2 to 4 mm, and the Shore A hardness of the jacket material lying above the upper surface of the elastomeric strip is not greater than the Shore A hardness of the jacket material lying below the upper surface of the elastomeric strip.

12. A sensing device according to claim 1
including a twin-conductor connecting cable extending from one end of the device for connection to an electrical circuit, each cable conductor being electrically connected to a respective one of the conductors of the sensing device, and the region of connection being encapsulated within the jacket material.

13. A vehicle sensing device according to claim 12 in which the region of connection is surrounded by a tube of rigid material extending from the end region of the connector cable to beyond the region of connection, the interior of the tube being filled with electrically insulating material, and the tube being encapsulated in the jacket material.

14. A vehicle sensing device comprising an elongate sensing device comprising a carrier strip of electrically insulating material; two transversely spaced electrical conductors extending longitudinally of the carrier strip and spaced apart transversely of the carrier strip so that there is no direct contact between the conductors; a strip of elastomeric material, overlying both conductors the strip of elastomeric material being discontinued at one end of the sensing device to leave parts of the conductors exposed in a connection region; a backing strip bonded to the carrier strip, the backing strip being of a material that will resist kinking and permanent set under application of a bending moment; a twin-conductor connecting cable; means connecting each cable conductor to a respective conductor of the sensing device in the connection region; stress-resisting means surrounding the connection region and extending longitudinally from the end region of the cable to beyond the commencement of the strip of elastomeric material; the exposed parts of the conductors, stress-resisting means and an end section of the cable all being wholly encapsulated in a water-resistant and abrasion-resistant jacket of elastomeric material.

15. A vehicle sensing device according to claim 14 in which the stress-resisting means comprises a rigid tube, the connection region lying within the tube and remaining space within the tube being filled with an electrically insulatin material.

* * * * *